US008874327B2

(12) United States Patent
Ishihara et al.

(10) Patent No.: US 8,874,327 B2
(45) Date of Patent: Oct. 28, 2014

(54) CONTROL DEVICE FOR HYBRID CONSTRUCTION MACHINERY

(75) Inventors: Shinji Ishihara, Hitachinaka (JP); Shinya Imura, Toride (JP); Masatoshi Hoshino, Tsuchiura (JP); Kazuo Fujishima, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 13/985,118

(22) PCT Filed: Jan. 5, 2012

(86) PCT No.: PCT/JP2012/050125
§ 371 (c)(1),
(2), (4) Date: Aug. 13, 2013

(87) PCT Pub. No.: WO2012/117750
PCT Pub. Date: Sep. 7, 2012

(65) Prior Publication Data

US 2013/0325268 A1 Dec. 5, 2013

(30) Foreign Application Priority Data

Mar. 1, 2011 (JP) ..... 2011-044257

(51) Int. Cl.
*G06F 7/00* (2006.01)
*E02F 9/20* (2006.01)
*E02F 9/22* (2006.01)

(52) U.S. Cl.
CPC ..... *E02F 9/22* (2013.01); *E02F 9/2066* (2013.01); *E02F 9/2246* (2013.01)
USPC ..... 701/50

(58) Field of Classification Search
USPC ..... 701/22, 50; 180/65.265, 65.31
See application file for complete search history.

(56) References Cited

U.S. PATENT DOCUMENTS

| | | | | |
|---|---|---|---|---|
| 5,890,468 | A * | 4/1999 | Ozawa | 123/561 |
| 6,366,838 | B1 * | 4/2002 | Yoshino et al. | 701/22 |
| 6,625,525 | B2 * | 9/2003 | Yoshino et al. | 701/22 |
| 7,178,618 | B2 * | 2/2007 | Komeda et al. | 180/65.275 |
| 8,371,117 | B2 * | 2/2013 | Nakamura et al. | 60/449 |
| 2011/0092334 | A1 * | 4/2011 | Baino et al. | 477/5 |
| 2013/0151055 | A1 * | 6/2013 | Kaneko et al. | 701/22 |

FOREIGN PATENT DOCUMENTS

| | | |
|---|---|---|
| JP | 2004-150306 | 5/2004 |
| JP | 2007-218111 | 8/2007 |
| JP | 2009-13632 | 1/2009 |

* cited by examiner

*Primary Examiner* — Yonel Beaulieu
(74) *Attorney, Agent, or Firm* — Antonelli, Terry, Stout & Kraus, LLP.

(57) ABSTRACT

Target rotation speed setup section for setting a target engine rotation speed; load detection for detecting a hydraulic pump load; an assist output computation section for calculating an assist output to be generated by a motor generator in accordance with a rotation speed deviation ΔN, which is the difference between an actual and target rotation speed, or in accordance with the hydraulic pump load; an absorption torque upper limit computation section for calculating an absorption torque upper limit value of the hydraulic pump; and an operation signal generation section for generating the operation signal to be output to a pump displacement adjustment device. When the rotation speed deviation ΔN is equal to or more than a setting NC determined in accordance with the assist output value, the absorption torque upper limit computation section reduces the absorption torque upper limit value of the hydraulic pump from the calculated value.

8 Claims, 11 Drawing Sheets

CONTROL DEVICE FOR HYBRID CONSTRUCTION MACHINERY

TECHNICAL FIELD

The present invention relates to a hydraulic excavator, a wheel loader, and other hybrid construction machines having a hydraulic actuator, and more particularly, to a control device therefor.

BACKGROUND ART

A hydraulic excavator or other construction machine driven by a hydraulic system often includes a large-size engine that is selected for operations performed at maximum load and capable of performing all sorts of operations ranging from light-load operations to heavy-load operations. However, the heavy-load operations (e.g., heavy excavating work performed by the hydraulic excavator for frequent excavating and loading of earth) performed by the construction machine account for only a part of all operations performed the construction machine. Therefore, even if the construction machine includes such a large-size engine, its capacity is not fully used during a light-load operation or a medium-load operation (e.g., light excavating work performed by the hydraulic excavator for earth surface leveling). This problem should be avoided from the viewpoint of fuel consumption reduction. There is a known hybrid construction machine that addresses the above problem by employing a small-size engine to reduce fuel consumption and by providing assist with a motor generator that compensates for output deficiency due to the use of the small-size engine.

A technology concerning a hybrid construction machine is described, for instance, in JP-A-2007-218111. This technology is designed to provide an operator with an improved operation feeling when an engine running at a low speed is rapidly accelerated, for instance, to promptly resume an operation from an idle state. A control device for the hybrid construction machine, which incorporates the above technology, includes determination means for determining, in accordance with a target rotation speed of the engine (motor generator), an actual rotation speed of the motor generator, and the amount of electric power remaining in an electrical storage device, whether an assist output generated by the motor generator is required. If the determination means determines that the generation of the assist output is not required, a first maximum torque line is selected as a maximum torque line indicative of a maximum absorption torque that can be absorbed by a hydraulic pump. The first maximum torque line increases a maximum absorption torque when the target rotation speed of the engine increases. If, on the other hand, the determination means determines that the generation of the assist output is required, a second maximum torque line is selected as the maximum torque line. The second maximum torque line provides a higher maximum absorption torque in a low rotation speed region of the engine than the first maximum torque line. This ensures that when the motor generator generates the assist output, the torque absorbed by the hydraulic pump during an increase in the engine's rotation speed is higher than that when the motor generator does not generate the assist output. Consequently, the construction machine starts moving earlier in response to the movement of an operating lever, thereby reducing an uncomfortable operation feeling given to the operator.

PRIOR ART LITERATURE

Patent Document

Patent Document 1: JP-2007-218111-A

SUMMARY OF THE INVENTION

Problem to be Solved by the Invention

In order to reduce the fuel consumption of the hybrid construction machine, it is preferred that the motor generator as well as the engine be reduced in electric power consumption and in size.

The above technology will now be discussed from the viewpoint mentioned above. The above technology uniquely determines the maximum absorption torque of the hydraulic pump in accordance with the engine's rotation speed. Further, when the motor generator assists the engine, the maximum absorption torque in the low rotation speed region is higher than in a different region. Hence, if a heavy load is imposed on a work device while the engine is running in the low rotation speed region, a heavy load is also imposed on the engine. Therefore, if an engine torque assist provided by the motor generator is insufficient or delayed, a lug-down may occur to decrease the engine's rotation speed or, in some cases, the engine may stall. If the lug-down occurs, an abrupt fuel injection occurs in an attempt to restore the engine's rotation speed to the target rotation speed. This results in the generation of black exhaust or other degradation of emissions and in the deterioration of fuel efficiency. In addition, changes in the sound of the engine, which are caused by a decrease in the engine's rotation speed, bring a feeling of discomfort to the operator.

To avoid the above situation, it is necessary that the motor generator transiently generate a high assist output. However, the generation of such a high assist output increases the amount of electric power consumption and deteriorates the fuel efficiency in opposition to a design intention of improving the fuel efficiency by having the motor generator assist a downsized engine. Besides, the size of the motor generator needs to be increased in order to provide a great torque assist. However, increasing the size of the motor generator results in an increase in the capacity of the electrical storage device which supplies electric power to the motor generator. This makes it difficult to reduce the sizes of electrically-driven components, thereby also making it difficult to downsize the construction machine.

The present invention has been made to address the above-described problem. An object of the present invention is to provide a control device for a low-power and fuel-efficient hybrid construction machine that suppresses the transient generation of an assist output by a motor generator when an engine is accelerated.

Means for Solving the Problem

According to an aspect of the present invention, there is provided a control device for a construction machine having an engine, a variable displacement hydraulic pump driven by the engine, a hydraulic actuator driven by a hydraulic fluid discharged from the hydraulic pump, a motor generator for exchanging torque with the engine, electrical storage means for supplying electric power to the motor generator, and pump displacement adjustment means for adjusting the displacement of the hydraulic pump in accordance with an operation signal, the control device including actual rotation speed detection means, target rotation speed setup means, load detection means, assist output computation means, absorption torque upper limit computation means, and operation signal generation means. The actual rotation speed detection means detects an actual rotation speed of the engine. The target rotation speed setup means sets a target rotation speed of the engine. The load detection means detects a load on the hydraulic pump. The assist output computation means calculates an assist output value which is to be generated by the motor generator, in accordance with a rotation speed deviation which is the difference between the actual rotation speed, the data about the actual rotation speed being input from the actual rotation speed detection means, and the target rotation speed, the data about the target rotation speed being input from the target rotation speed setup means, or in accordance with the load on the hydraulic pump, the data about the load on the hydraulic pump being input from the load detection means. The absorption torque upper limit computation means calculates an absorption torque upper limit value of the hydraulic pump. The operation signal generation means generates the operation signal to be output to the pump displacement adjustment means for the purpose of adjusting the displacement of the hydraulic pump in accordance with the value calculated by the absorption torque upper limit computation means. When the rotation speed deviation is equal to or more than a setting value that is determined in accordance with the assist output value calculated by the assist output computation means, the absorption torque upper limit computation means reduces the absorption torque upper limit value of the hydraulic pump from the calculated value.

Advantages of the Invention

The present invention makes it possible to reduce the rotation speed of the engine when an increased load is imposed on a work device.

MODE FOR CARRYING OUT THE INVENTION

Figure 1:
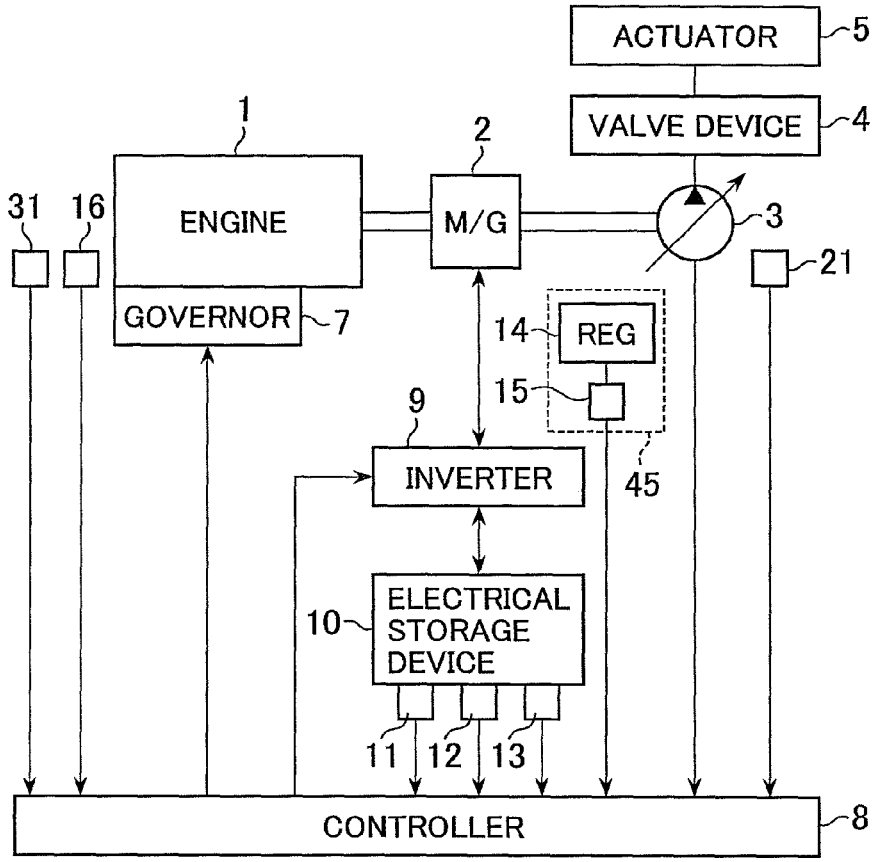
FIG. 1 is a schematic diagram illustrating a hydraulic drive control device for a hybrid hydraulic excavator according to an embodiment of the present invention.

An embodiment of the present invention will now be described with reference to the accompanying drawings. FIG. 1 is a schematic diagram illustrating a hydraulic drive control device for a hybrid hydraulic excavator according to the embodiment of the present invention. The hydraulic drive control device shown in FIG. 1 includes an engine 1, a governor 7 for adjusting the fuel injection amount of the engine 1, a rotation speed sensor (actual rotation speed detection means) 16 for detecting the actual rotation speed of the engine 1, an engine torque sensor (engine torque detection means) 31 for detecting the torque of the engine 1, a variable displacement hydraulic pump 3 (hereinafter may be simply referred to as the "hydraulic pump 3") driven by the engine 1, a hydraulic actuator 5 driven by a hydraulic fluid discharged from the hydraulic pump 3, a motor generator 2 disposed on a drive shaft of the engine 1 to exchange torque with the engine 1, an electrical storage device (electrical storage means) 10 for supplying electric power to the motor generator 2, a pump displacement adjustment device (pump displacement adjustment means) 45 for adjusting the displacement of the hydraulic pump 3, an inverter (motor generator control means) 9 for controlling the rotation speed of the motor generator 2 and exchanging electric power with the electrical storage device 10 as needed, and a controller (control device) 8 for controlling the governor 7 to adjust the fuel injection amount and regulate the engine's rotation speed and controlling the inverter 9 to regulate the torque of the motor generator 2.

The hydraulic drive control device shown in FIG. 1 first supplies the hydraulic fluid, which is discharged from the hydraulic pump 3, to a valve device 4 having a plurality of control valves, then causes the valve device 4 to change as needed the flow rate, direction, and pressure of the hydraulic fluid, and forwards the hydraulic fluid to each hydraulic actuator 5 for the purpose of controlling the drive of each hydraulic actuator 5. The hydraulic actuator 5 disposed in the hydraulic excavator according to the present embodiment includes, for example, hydraulic cylinders (boom cylinder, arm cylinder, bucket cylinder, etc.) for driving a multijoint front work device mounted on the front of an upper turning structure, a hydraulic motor (turning motor) for turning the upper turning structure, and a hydraulic motor (travel motor) for running a lower travel structure mounted on the bottom of the upper turning structure. In FIG. 1, these components are generically represented by the hydraulic actuator 5.

The speed of the engine 1 is regulated when the governor 7 controls the fuel injection amount. The hydraulic pump 3 is provided with means for detecting information necessary for computing the load imposed on the hydraulic pump 3 (pump information detection means 21). The pump information detection means 21 includes a discharge pressure sensor, a flow meter, and a tilting angle sensor. The discharge pressure sensor measures the pressure of the hydraulic fluid discharged from the hydraulic pump 3. The flow meter measures the flow rate of the hydraulic fluid. The tilting angle sensor measures the tilting angle of the hydraulic pump 3. The discharge pressure sensor, the flow meter, and the tilting angle sensor output detected sensor values to the controller 8. A pump load computation section 26 (described later) of the controller 8 computes the load on the hydraulic pump 3 in accordance with the sensor values input from the pump information detection means 21.

The pump displacement adjustment device 45 adjusts the displacement of the hydraulic pump 3 in accordance with an operation signal output from the controller 8. The pump displacement adjustment device 45 includes a regulator 14 and a solenoid proportional valve 15. The regulator 14 is attached to the hydraulic pump 3. When the regulator 14 adjusts the tilting angle of a swash plate or swash shaft of the hydraulic pump 3, the displacement (displacement volume) of the hydraulic pump 3 is changed to control an absorption torque of the hydraulic pump 3 (pump absorption torque control). The regulator 14 according to the present embodiment is controlled by a control pressure generated by the solenoid proportional valve 15. The solenoid proportional valve 15 operates in accordance with a command value output from an operation signal generation section 24 (described later) of the controller 8.

Figure 2:
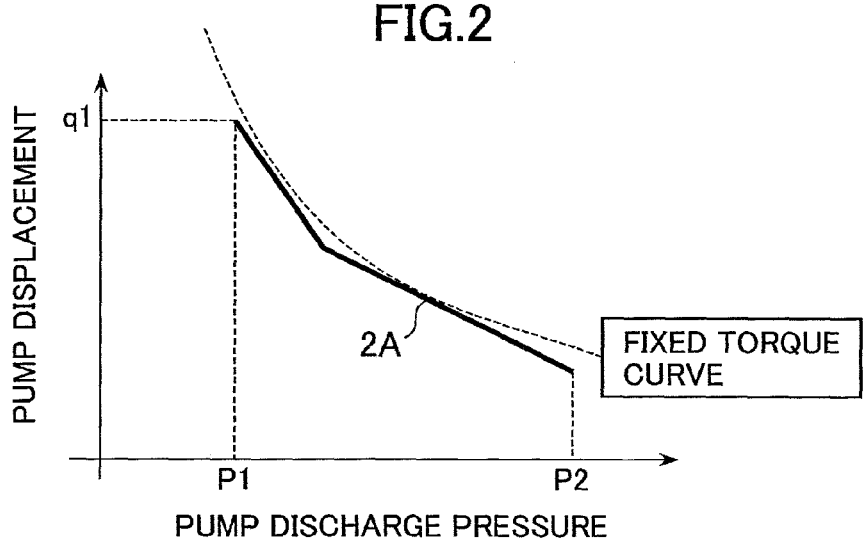
FIG. 2 is a control characteristic diagram illustrating how a pump absorption torque is controlled by a regulator 14 according to the embodiment of the present invention.

The regulator 14 according to the present embodiment controls the displacement of the hydraulic pump 3 in accordance with a control characteristic diagram of FIG. 2. FIG. 2 is a control characteristic diagram illustrating how a pump absorption torque is controlled by the regulator 14 according to the embodiment of the present invention. The polygonal curve 2A shown in FIG. 2 indicates the characteristics of the displacement of the hydraulic pump 3, which are set with respect to the discharge pressure of the hydraulic pump 3 so that the torque of the hydraulic pump 3 (the product of the pump's displacement and the pump's discharge pressure) remains substantially fixed without exceeding the maximum value of the sum of the outputs of the engine 1 and motor generator 2 (hyperbolic curve indicated by the broken line in FIG. 2 (fixed torque curve)). In other words, when the displacement of the hydraulic pump 3 is set by using the polygonal curve 2A in accordance with the prevailing pump discharge pressure, control can be exercised so that the torque of the hydraulic pump 3 does not exceed the maximum output provided by the engine 1 and the motor generator 2. If the pump discharge pressure is not higher than P1, pump absorption torque control is not exercised. In this instance, the pump displacement is determined by the amount of operation performed by an operating lever that operates each control valve of the valve device 4 (e.g., the pump displacement is q1 when the amount of operation performed by a certain operating lever is maximized). If, on the other hand, the pump discharge pressure is between P1 and P2, the regulator 14 exercises pump absorption torque control. In this instance, the regulator 14 adjusts the pump tilting angle so that the pump displacement decreases along the polygonal curve 2A when the pump discharge pressure increases. Consequently, control is exercised so that the pump absorption torque is not higher than a torque prescribed by the polygonal curve 2A. The value P2 is the maximum value of the pump discharge pressure and equal to a pressure setting of a relief valve connected to a circuit that is included in the valve device 2 and used for the hydraulic pump 3. Here, the control characteristic diagram adopted for controlling a hydraulic pump absorption torque uses the polygonal curve 2A formed by two straight lines. However, an alternative control characteristic diagram may be used as far as setup is performed without exceeding the fixed torque curve (hyperbolic curve) shown in FIG. 2. The controller 8 outputs an operation signal (electrical signal), which is generated in accordance with the absorption torque of the hydraulic pump 3, to the solenoid proportional valve 15. The solenoid proportional valve 15 drives the regulator 14 by generating a control pressure corresponding to the operation signal. This causes the regulator 14 to change the displacement of the hydraulic pump 3 so that the absorption torque of the hydraulic pump 3 is adjusted in such a manner as to avoid an engine stall.

A current sensor 11, a voltage sensor 12, and a temperature sensor 13 are mounted on the electrical storage device 10, which includes, for example, a battery or a capacitor. These sensors 11, 12, 13 are used as electrical storage information detection means 22, which detect information necessary for computing a storage amount (a remaining electric power amount) of the electrical storage device 10. In accordance with the information detected by these sensors 11, 12, 13, such as a current, a voltage, and a temperature, the controller 8 causes a storage amount computation section 25 (described later) to compute the storage amount of the electrical storage device 10 and manages the storage amount of the electrical storage device 10.

Figure 3:
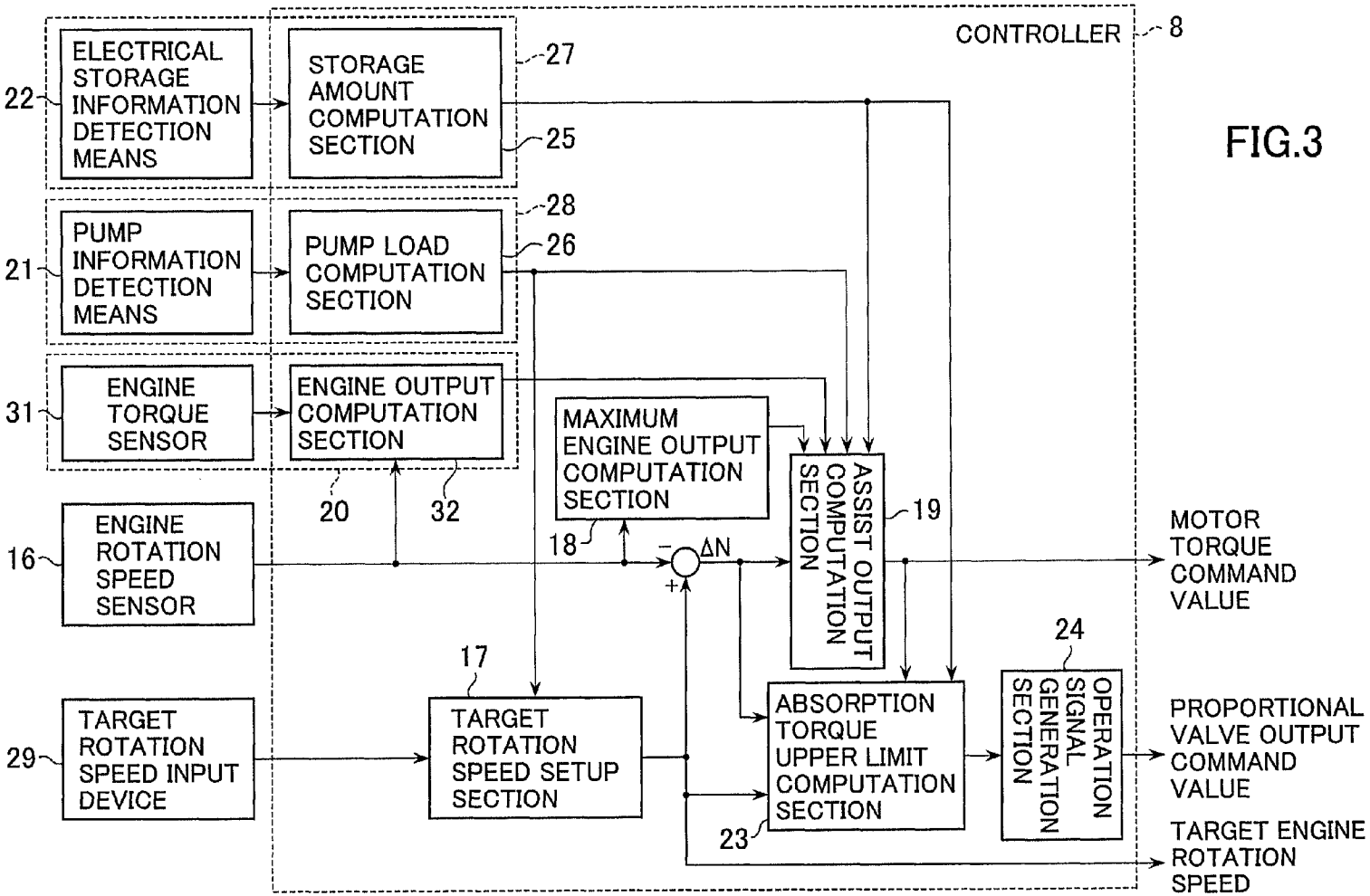
FIG. 3 is a schematic diagram illustrating the configuration of a controller 8 according to the embodiment of the present invention.

FIG. 3 is a schematic diagram illustrating the configuration of the controller 8 according to the embodiment of the present invention. The controller 8 shown in FIG. 3 computes command values for the engine 1, the motor generator 2, and the hydraulic pump 3, and includes a target rotation speed setup section (target rotation speed setup means) 17, a maximum engine output computation section (maximum engine output computation means) 18, an assist output computation section (assist output computation means) 19, an absorption torque upper limit computation section (absorption torque upper limit computation means) 23, an operation signal generation section (operation signal generation means) 24, a storage amount computation section 25, a pump load computation section 26, and an engine output computation section 32.

The controller 8 inputs data about an actual engine rotation speed detected by the rotation speed sensor (actual rotation speed detection means) 16, data about an engine torque detected by the engine torque sensor (engine torque detection means) 31, electrical storage information (the current, voltage, and temperature of the electrical storage device 10) detected by the electrical storage information detection means 22, pump information (the pressure and flow rate of the hydraulic fluid and the tilting angle of the hydraulic pump 3) detected by the pump information detection means 21, and data about a target engine rotation speed input from a target rotation speed input device 29 (e.g., engine control dial), which is disposed in a cab of the hydraulic excavator and manipulated by an operator to input a desired target engine rotation speed.

The storage amount computation section 25 computes the storage amount of the electrical storage device 10 in accordance with the electrical storage information input from the current sensor 11, voltage sensor 12, and temperature sensor 13 (electrical storage information detection means 22). The storage amount computation section 25 and the electrical storage information detection means 22 form a storage amount detection section 27. The storage amount value computed by the storage amount computation section 25 is output to the assist output computation section 19 and to the absorption torque upper limit computation section 23.

The pump load computation section 26 computes the load on the hydraulic pump 3 in accordance with the pump information input from the discharge pressure sensor, the flow meter, and the tilting angle sensor (pump information detection means 21). The pump load computation section 26 and the pump information detection means 21 form a pump load detection section 28. The pump load value computed by the pump load computation section 26 is output to the assist output computation section 19.

The engine output computation section 32 computes an actual output of the engine 1 in accordance with the engine torque, the value of which is input from the engine torque sensor 31. The engine output computation section 32 and the engine torque sensor 31 form an engine output detection section (engine output detection means) 20. The output value computed by the engine output computation section 32 is output to the assist output computation section 19.

The target rotation speed setup section 17 sets a target rotation speed of the engine 1 in such a manner as to obtain an engine output in accordance with the load on the hydraulic pump 3 (the load condition of the hydraulic actuator 5), which is calculated by the pump load computation section 26. This target rotation speed takes precedence over a value input from the target rotation speed input device 29. In this instance, from the viewpoint of reducing the fuel consumption amount of the engine 1, it is preferred that an operating point at which the fuel consumption amount for the output required of the engine 1 is minimized be set as a target rotation speed command value for the engine 1. The target rotation speed set by the target rotation speed setup section 17 is output to the absorption torque upper limit computation section 23 and to the operation signal generation section 24. Further, the target rotation speed is output to the assist output computation section 19 as an deviation from the actual rotation speed detected by the rotation speed sensor 16. The target rotation speed, which is set as described above, is also used to control the motor generator 2. However, when the engine 1 is connected to the motor generator 2 through a speed reducer or the like, a value obtained by multiplying a target rotation speed setting by the speed reduction ratio of the speed reducer should be defined as a separate target rotation speed and used.

In accordance with the actual rotation speed of the engine 1, the value of which is input from the rotation speed sensor 16, and with a table that is formulated according to engine characteristics and stored in a memory device (ROM or the like), the maximum engine output computation section 18 computes a maximum output that can be generated by the engine 1. The maximum output value computed by the maximum engine output computation section 18 is output to the assist output computation section 19.

The assist output computation section 19 computes a motor torque command value (assist output command value), which the motor generator 2 should output in order to provide acceleration assist and power assist. The acceleration assist is provided to accelerate the engine 1 so as to rapidly achieve the target rotation speed set by the target rotation speed setup section 17. The power assist is provided to compensate for the output shortfall of the engine. More specifically, the assist output computation section 19 calculates an assist output value(engine assist output value) which is to be generated from the motor generator 2, in accordance with a rotation speed deviation ΔN which is the difference between the actual rotation speed, the value of which is input from the rotation speed sensor 16, and the target rotation speed, the value of which is input from the target rotation speed setup section 17, or in accordance with the load on the hydraulic pump 3, the value of which is input from the pump load detection section 28. The assist output computation section 19 will now be described in detail with reference to an accompanying drawing.

Figure 4:
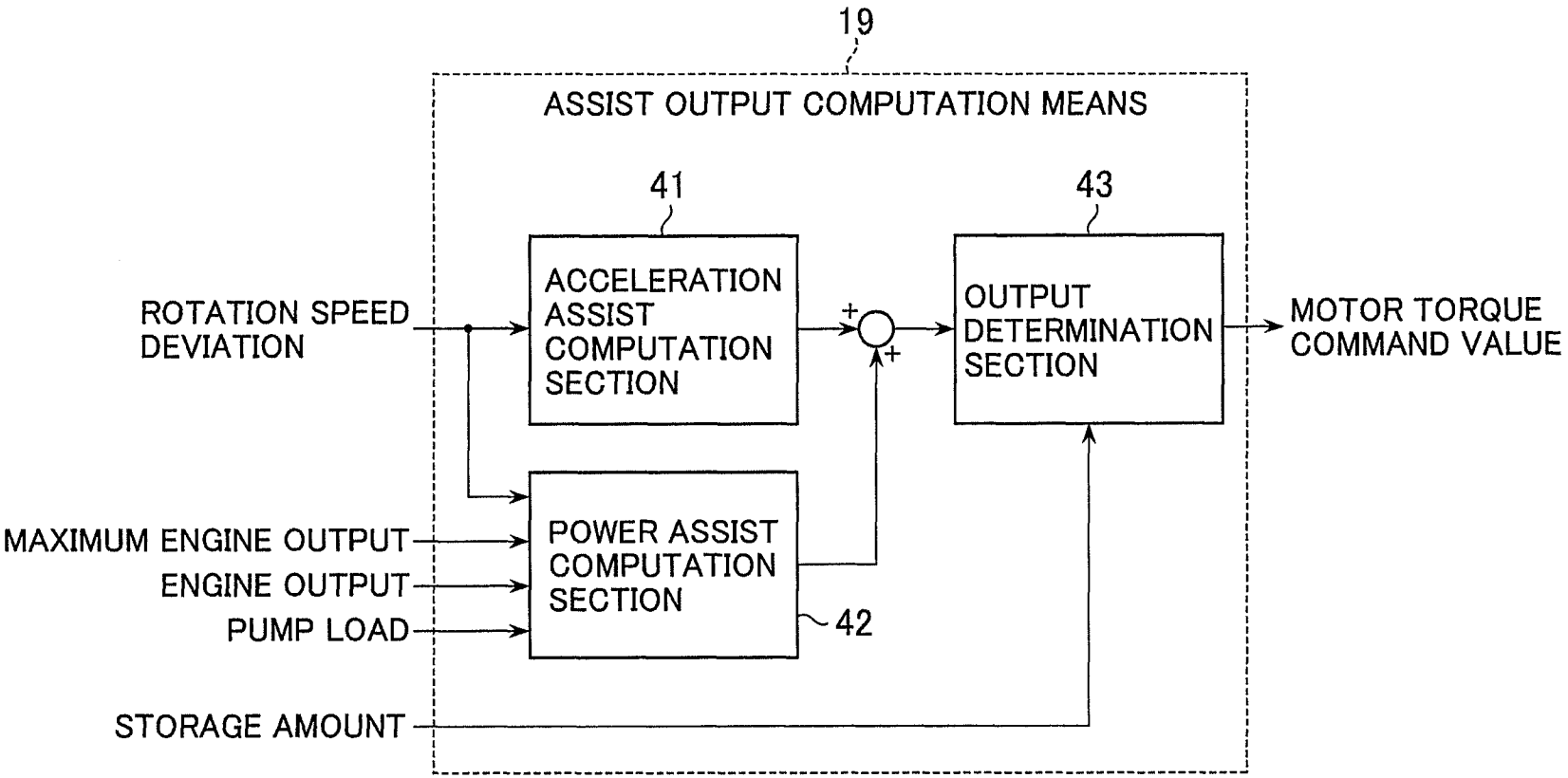
FIG. 4 is a schematic diagram illustrating the configuration of an assist output computation section 19 according to the embodiment of the present invention.

FIG. 4 is a schematic diagram illustrating the configuration of the assist output computation section 19 according to the embodiment of the present invention. The assist output computation section 19 shown in FIG. 4 includes an acceleration assist computation section 41, a power assist computation section 42, and an output determination section 43.

The acceleration assist computation section 41 computes the assist output value (acceleration assist output value) of the motor generator 2 when an assist (acceleration assist) is to be provided for the output of the engine 1 in order to accelerate the engine 1 by immediately raising its actual rotation speed to the target rotation speed. The rotation speed deviation ΔN, which is the difference between the target rotation speed and actual rotation speed of the engine 1, is input to the acceleration assist computation section 41. In the acceleration assist computation section 41, the assist output value is computed in accordance with the rotation speed deviation ΔN, which is the difference between the target rotation speed and actual rotation speed of the engine 1. The assist output value gradually decreases when the rotation speed deviation ΔN approaches zero. From the viewpoint of immediately accelerating the engine 1 when the rotation speed deviation ΔN is relatively great, it is preferred that the acceleration assist computation section 41 compute the assist output value by mainly exercising derivative control and proportional control.

The power assist computation section 42 computes the assist output value (power assist output value) of the motor generator 2 when an assist (power assist) needs to be provided by the motor generator 2 because the output of the engine 1 is insufficient. The data of the rotation speed deviation ΔN, the maximum engine output value, the engine output, and the pump load is input to the power assist computation section 42. In the power assist computation section 42, the assist output value is computed in accordance with the difference between the load on the hydraulic pump 3, the data of which is input from the pump load computation section 26, and the engine output, the data of which is input from the engine output computation section 32 (engine output detection section 20). If the maximum engine output value, the data of which is input from the maximum engine output computation section 18, is referenced in the above computation process, the minimum value of the power assist output value that may be necessary for the prevailing actual rotation speed of the engine 1 can be calculated. If the output generated only from the engine 1 is insufficient, a steady assist output value is often required. It is therefore preferred that the power assist computation section 42 compute the assist output value by using a feedforward input function and by exercising integral control. Further, from the viewpoint of preventing an engine stall from being caused by overloading, when the present embodiment computes a feedforward input, the difference between the pump load detected by the pump load detection section 28 and the engine output detected by the engine output detection section 20 is calculated as the assist output value to be generated by the motor generator 2.

The output determination section 43 adds up the assist output value calculated by the acceleration assist computation section 41 and the assist output value calculated by the power assist computation section 42 to generate a motor torque command value corresponding to the sum of the assist outputs. The sum of the assist output value calculated by the acceleration assist computation section 41 and the assist output value calculated by the power assist computation section 42 and the storage amount value of the electrical storage device 10 are input to the output determination section 43. Further, if the assist output value computed by the assist computation sections 41, 42 cannot be generated because the storage amount value of the electrical storage device 10, which is input from the storage amount computation section 25, is small, the output determination section 43 can limit the amount of assist output generated by the motor generator 2 and calculate a motor torque command value corresponding to the limited assist output value. Furthermore, if the storage amount of the electrical storage device 10 is small (e.g., smaller than a setting) and no engine assist is required, the output determination section 43 can calculate a motor torque command value that causes the motor generator 2 to generate electric power.

In accordance with the maximum engine output value, which is input from the maximum engine output computation section 18, and with the engine output value, which is input from the engine output detection section 20, the assist output computation section 19 may compute the assist output to be generated from the motor generator 2. In such an instance, the assist output generated by the motor generator 2 is determined in accordance with the current output of the engine 1 and with the maximum output value of the engine 1 at the engine's current rotation speed. Therefore, while the output of the engine 1 is more than adequate, it is possible to avoid the wasteful consumption of electric power remaining in the electrical storage device 10 without causing the motor generator 2 to provide an assist. Further, when the engine output is maximized, an assist is provided immediately. This makes it possible to not only avoid an engine stall, but also causes the engine rotation speed to responsively follow the target rotation speed.

Returning to FIG. 3, the absorption torque upper limit computation section 23 computes the upper limit value (maximum value) of the absorption torque (input torque) of the hydraulic pump 3. The absorption torque upper limit value computed by the absorption torque upper limit computation section 23 is output to the operation signal generation section 24.

The absorption torque upper limit computation section 23 according to the present embodiment usually calculates the pump absorption torque upper limit value in accordance with the control characteristic diagram of FIG. 2. However, if the rotation speed deviation ΔN is not smaller than its setting value (hereinafter may be referred to as the "setting NC"), the pump absorption torque upper limit value is calculated by reducing a predetermined absorption torque from the value calculated from the control characteristic diagram of FIG. 2.

Figure 5:
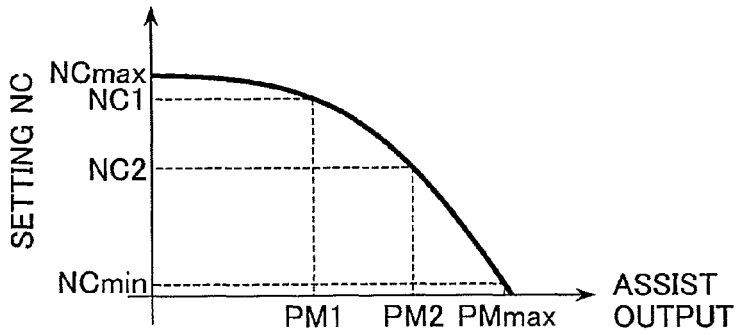
FIG. 5 is a diagram illustrating the relationship between a rotation speed deviation setting value NC according to the present embodiment and an assist output.

FIG. 5 is a diagram illustrating the relationship between the rotation speed deviation setting NC according to the present embodiment and the assist output. As shown in FIG. 5, the setting NC is determined in accordance with the assist output value calculated by the assist output computation section 19. More specifically, the setting NC shown in FIG. 5 takes a maximum value NCmax when the assist output value PM is zero, and takes a minimum value NCmin when the assist output value PM is maximized. In other words, the setting NC decreases with an increase in the assist output generated by the motor generator 2. Pump absorption torque control provided by the absorption torque upper limit computation section 23 when the rotation speed deviation ΔN is equal to or more than its setting NC will now be described with reference to an accompanying drawing.

Figure 6:
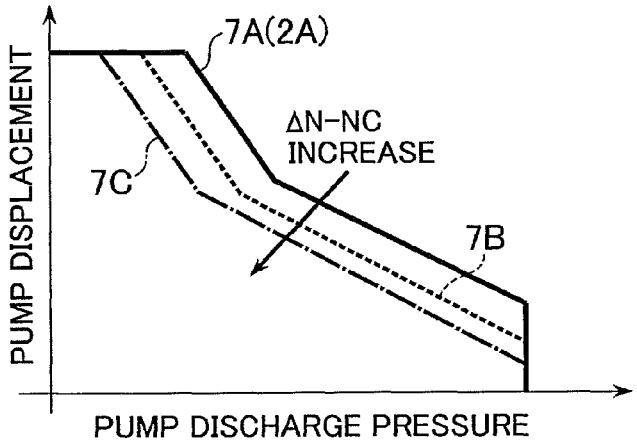
FIG. 6 shows exemplary changes in the control characteristic diagram indicative of pump absorption torque control exercised by the regulator 14 when a rotation speed deviation ΔN is equal to or more than the setting value NC.

FIG. 6 shows exemplary changes in the control characteristic diagram indicative of pump absorption torque control exercised by the regulator 14 when the rotation speed deviation ΔN is not smaller than the setting NC. For brevity of explanation, let us assume that the rotation speed deviation ΔN changes from a value smaller than the setting NC to a value greater than the setting NC while the assist output and the setting NC remain unchanged, and that a polygonal curve 7A in FIG. 6 corresponds to the polygonal curve 2A in FIG. 2. In this case, when the rotation speed deviation ΔN increases to a value not smaller than the setting NC, the absorption torque upper limit computation section 23 according to the present embodiment decreases the pump absorption torque upper limit value so that the polygonal curve shifts from 7A to 7B and from 7B to 7C in accordance with the difference between the rotation speed deviation ΔN and the setting NC. When the pump absorption torque upper limit value is decreased in the above manner, the pump absorption torque can be reduced in accordance with the magnitude of the rotation speed deviation ΔN. Therefore, the load on the engine 1 or the load on the motor generator 2 can be reduced in accordance with the magnitude of the rotation speed deviation ΔN.

The polygonal curve indicative of the control characteristics may be shifted stepwise (e.g., in three steps, namely, 7A, 7B, and 7C shown in FIG. 7) in accordance with the difference between the rotation speed deviation ΔN and the setting NC or gradually shifted from 7A to 7C in accordance with the difference between the rotation speed deviation ΔN and the setting NC. When the latter control characteristics are used, it is possible to inhibit the pump absorption torque upper limit value from changing drastically. Therefore, the latter control characteristics can better suppress the degradation of the operability of the front work device than the former control characteristics. Further, as a parameter for shifting the polygonal curve indicative of the control characteristics can be defined with a function, the latter control characteristics eliminate the necessity of preparing many data tables unlike the former control characteristics. A case where the polygonal curve indicative of the control characteristics is gradually shifted from 7A to 7C in accordance with the difference between the rotation speed deviation ΔN and the setting NC will be described below with reference to an accompanying drawing.

Figure 7:
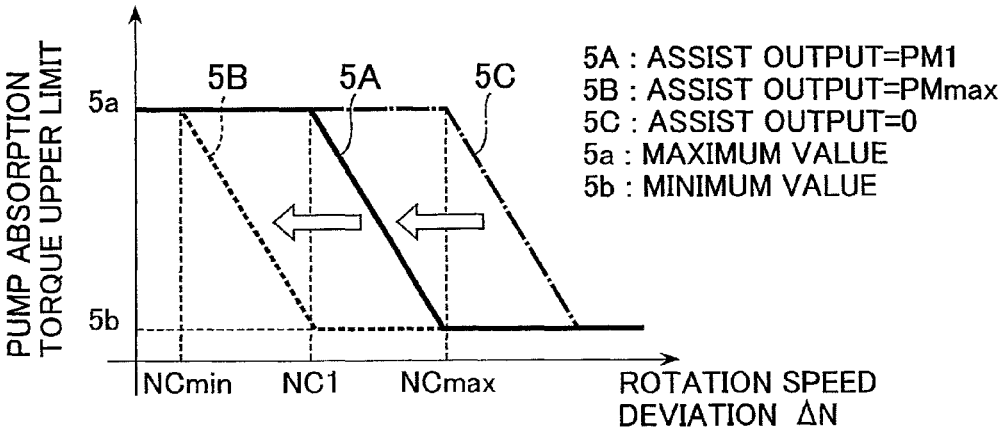
FIG. 7 shows exemplary changes in a characteristic diagram indicative of a pump absorption torque upper limit value, which occur when the assist output value is changed.

FIG. 7 shows exemplary changes in a characteristic diagram indicative of the pump absorption torque upper limit value that occur when the assist output value is changed (i.e., the setting NC is changed). A characteristic diagram obtained by parallelly shifting a reference characteristic diagram in a horizontal direction (in the direction of a horizontal axis) in accordance with the assist output value will be described here as a characteristic diagram concerning each assist output value (in this instance, the characteristic diagrams are parallelly shifted in a leftward direction, as indicated by arrows in FIG. 7, in accordance with an increase in the assist output value).

Referring to FIG. 7, let us assume that the characteristic diagram of the pump absorption torque upper limit value prevailing when the assist output value shown in FIG. 5 is in a PM1 state (setting NC=NC1) is in a 5A state shown in FIG. 7. In this case, if the rotation speed deviation ΔN is not greater than a setting NC1, control is exercised by using a pump absorption torque upper limit value 5*a* corresponding to the target rotation speed of the engine 1 (i.e., absorption torque control is exercised on the polygonal curve 7A in FIG. 6) without decreasing the pump absorption torque upper limit value, that is, without exercising torque reduction control over the absorption torque of the hydraulic pump 3. In this instance, the pump absorption torque upper limit value need not be limited. This makes it possible to maintain good operability of the front work device.

If, on the other hand, the rotation speed deviation ΔN is greater than the setting NC1, the amount of torque reduction increases in accordance with the magnitude of the rotation speed deviation ΔN (i.e., the polygonal curve in FIG. 6 shifts from 7A to 7C). This causes the pump absorption torque upper limit value to gradually decrease from an upper limit value 5*a* to a lower limit value 5*b* in accordance with an increase in the rotation speed deviation ΔN. When the amount of reduction of the pump absorption torque upper limit value is increased in accordance with the magnitude of the rotation speed deviation ΔN as described above, the load imposed on the engine 1 or on the motor generator 2 due to a hydraulic pump load can be reduced in accordance with the magnitude of the rotation speed deviation ΔN.

Further, if the rotation speed deviation ΔN increases beyond the setting NC1 and reaches a predetermined or greater value, the pump absorption torque upper limit value stops decreasing. In the example shown in FIG. 7, the value 5*b* is the minimum value of the pump absorption torque upper limit value; therefore, the pump absorption torque upper limit value stops decreasing when it reaches the value 5*b*. From the viewpoint of avoiding a situation where the front work device fails to become operative in response to an operating lever manipulated by the operator, at least a minimum pump absorption torque value required for operating the front work device should preferably be set as the minimum value of the pump absorption torque upper limit value. Further, from the viewpoint of permitting a prompt operation of the front work device by setting the pump absorption torque upper limit value to the highest possible value, it is preferred that the above minimum value be changeable as needed in accordance with the outputs of the engine 1 and the motor generator 2 and with the storage amount of the electrical storage device 10. More specifically, the above minimum value should preferably be increased in accordance with the magnitude of an extra output of the engine 1 and of the motor generator 2 and increased in accordance with the storage amount of the electrical storage device 10.

Next, let us assume that the characteristic diagram of the pump absorption torque upper limit value prevailing when the assist output value shown in FIG. 5 is in the maximum (PMmax) state (setting NC=NCmin) is in a 5B state shown in FIG. 7. This case corresponds, for example, to a case where the load on the engine 1 is increased due, for instance, to an increase in the load on the front work device in a state in which the characteristic diagram of the pump absorption torque upper limit value shown in FIG. 5 is used and the assist output generated by the motor generator 2 to compensate for the output shortfall of the engine 1 is maximized.

When the characteristic diagram is represented by 5B, the pump absorption torque upper limit value starts decreasing when the rotation speed deviation ΔN reaches the setting NCmin. Therefore, a value at which the pump absorption torque upper limit value starts decreasing is smaller than that when the characteristic diagram is represented by 5A (NC1). This makes it possible to avoid an overload condition in which the engine rotation speed unexpectedly decreases when the motor generator 2 provides an assist in a state where the engine output is substantially maximized.

Next, let us assume that the characteristic diagram of the pump absorption torque upper limit value prevailing when the assist output value shown in FIG. 5 is in the zero state (setting NC=NCmax) is in a 5C state shown in FIG. 7. This case corresponds, for example, to a case where the load on the engine 1 is decreased due, for instance, to a decrease in the load on the front work device in a state in which the characteristic diagram of the pump absorption torque upper limit value shown at 5A is used and the assist output generated by the motor generator 2 is not needed.

When the characteristic diagram is represented by 5C, the pump absorption torque upper limit value starts decreasing when the rotation speed deviation ΔN reaches the setting NCmax. Therefore, a value at which the pump absorption torque upper limit value starts decreasing is greater than that when the characteristic diagram is represented by 5A (NC1). As the motor generator 2 does not generate the assist output when the characteristic diagram is represented by 5C, the load on the hydraulic pump 3 is not heavier than the maximum output value of the engine 1. Therefore, the rotation speed deviation ΔN caused in this state strongly tends to be resolved by the output of the engine alone or by the assist output of the motor generator 2. In this instance, the pump absorption torque upper limit value need not be limited. This makes it possible to maintain good operability of the front work device.

If the pump absorption torque upper limit value is limited while the characteristic diagram is represented by 5C, the rotation speed deviation ΔN is greater than that when the characteristic diagram is represented by 5A or 5B (not smaller than NCc). It is conceivable that such a great rotation speed deviation ΔN may occur due, for instance, to a drastic increase in the pump load. Therefore, it is conceivable that a lug-down may occur when a conventional hydraulic excavator is used. In the above situation, however, the present embodiment increases the assist output value calculated by the assist output computation section 19 before an increase in the rotation speed deviation ΔN. In the present embodiment, therefore, the characteristic diagram gradually changes from 5C to 5A. As a result, no significant lug-down occurs in the present embodiment.

A control scheme used in the above example assumes that the actual pump absorption torque upper limit value used by the absorption torque upper limit computation section 23 is obtained by reducing the predetermined absorption torque from the pump absorption torque upper limit value set by using FIG. 2 (hereinafter may be referred to as the "reference absorption torque upper limit value"). However, an alternative is to set a table that inputs the value of the rotation speed deviation ΔN and returns a tolerance x ($0<x\leq1$) relative to the reference absorption torque upper limit value as shown in FIG. 8, multiply the reference absorption torque upper limit value by the tolerance set by the table, and use the resulting value as the actual pump absorption torque upper limit value.

Figure 8:
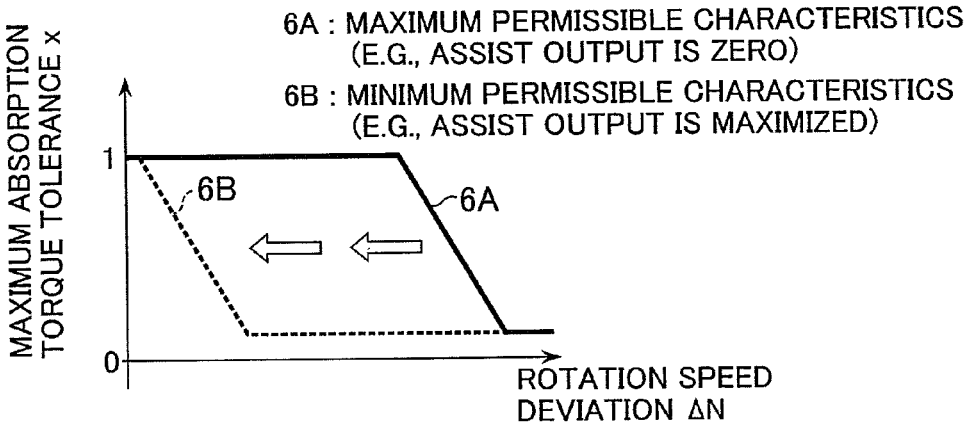
FIG. 8 shows an example of a table that sets a tolerance of the pump absorption torque upper limit value in accordance with the magnitude of the rotation speed deviation ΔN.

FIG. 8 shows an example of the table that sets the tolerance of the pump absorption torque upper limit value in accordance with the magnitude of the rotation speed deviation ΔN. The example shown in FIG. 8 assumes that the tolerance is calculated in accordance with the characteristic diagram shown at 6B when the assist output is maximized or in accordance with the characteristic diagram shown at 6A when the assist output is zero.

Although FIGS. 7 and 8 merely show a case where the pump absorption torque upper limit value linearly varies with the rotation speed deviation ΔN, the characteristic diagrams applicable to the present embodiment are not limited to those shown in FIGS. 7 and 8. It is also obvious that switching between the polygonal curves 5A, 5B, 5C shown in FIG. 7 need not always be linearly made in accordance with the assist output value. An alternative is to use hysteresis for switching purposes. Further, the maximum value 5*a* and minimum value 5*b* of the pump absorption torque upper limit value shown in FIG. 7 need not always be varied in accordance with the target engine rotation speed as described earlier. Alternatively, these values 5*a*, 5*b* may be varied in accordance, for instance, with the actual rotation speed of the engine 1 or other operating condition of the construction machine.

Returning to FIG. 3, the operation signal generation section 24 generates the operation signal (proportional valve output command value) that is to be output to the pump displacement adjustment device 45 (solenoid proportional valve 15) in order to adjust the displacement (pump absorption torque upper limit value) of the hydraulic pump 3 in accordance with the value calculated by the absorption torque upper limit computation section 23. The generated operation signal is output to the solenoid proportional valve 15. Upon receipt of the operation signal generated by the operation signal generation section 24, the solenoid proportional valve 15 generates a control pressure corresponding to the received operation signal to operate the regulator 14 in accordance with the magnitude of the control pressure. When the regulator 14 operates in this manner, the displacement of the hydraulic pump 3 changes. Hence, the absorption torque upper limit value of the hydraulic pump 3 is adjusted to the value calculated by the absorption torque upper limit computation section 23.

The behavior of the rotation speed deviation ΔN of the engine 1, of the pump absorption torque upper limit value, and of the assist output generated by the motor generator 2 in the construction machine according to the present embodiment, which is configured as described above, will now be described with reference to the accompanying drawings.

Figure 9:
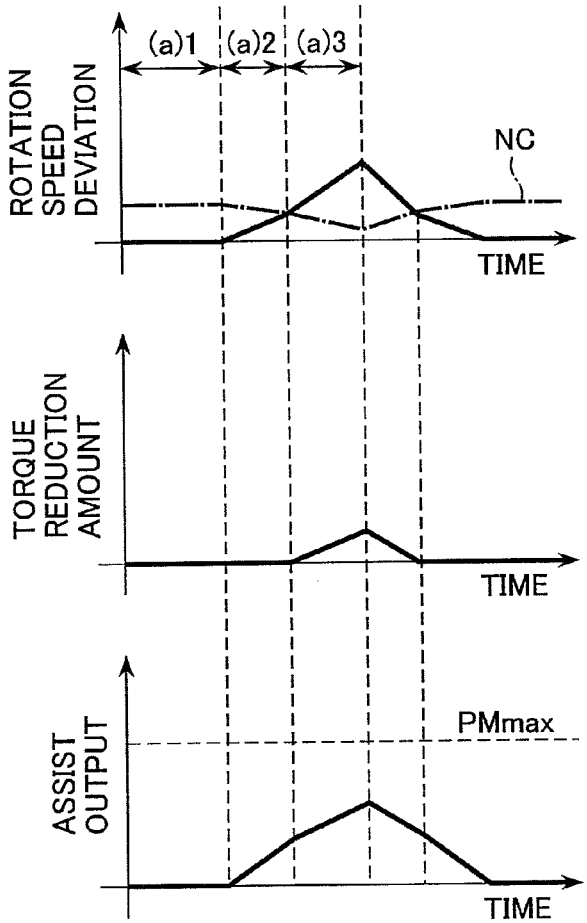
FIG. 9 shows an example illustrating how a construction machine is controlled when the load on a hydraulic pump 3 gradually increases to increase the assist output in a situation where an engine 1 is running at a target rotation speed with no assist output generated.

FIG. 9 shows an example illustrating how the construction machine is controlled when the load on the hydraulic pump 3 gradually increases to increase the assist output value in a situation where the engine 1 is running at a target rotation speed (i.e., rotation speed deviation ΔN=0) with no assist output generated. A one-dot chain line shown in FIG. 9 not only indicates changes in the setting NC, which are based on changes in the assist output, but also indicates changes in the rotation speed deviation ΔN.

Referring to FIG. 9, period (a)1 is a period during which a target rotation speed can be maintained solely by the output of the engine 1 and the assist output generated by the motor generator 2 is zero (i.e., setting NC=NCmax) because the load on the hydraulic pump 3 (output torque of hydraulic pump 3=pump displacement (or capacity)×pressure) is light. Period (a)2 is a period during which the rotation speed deviation ΔN cannot be resolved by the engine 1 alone so that the motor generator 2 starts generating the assist output. After the start of period (a)2, the setting NC of the rotation speed deviation ΔN gradually decreases from NCmax with an increase in the assist output (i.e., the characteristic diagram of FIG. 7 parallelly shifts in the leftward direction from the 5C state). However, as the rotation speed deviation ΔN still does not exceed the setting NC, the pump absorption torque upper limit value is not limited. At the end of period (a)2 (at the start of period (a)3), however, the rotation speed deviation ΔN reaches the setting NC, which is decreased with an increase in the assist output value. Therefore, the pump absorption torque upper limit value is limited so that torque reduction occurs. During period (a)3, the rotation speed deviation ΔN never decreases below the setting NC so that the pump absorption torque upper limit is limited in accordance with the difference between the rotation speed deviation ΔN and the setting NC. As this reduces the load on the engine 1, the rotation speed of the engine 1 can be brought close to the target rotation speed while suppressing the transient generation of a great assist output. In addition, it is also possible to prevent an engine stall from being caused by overloading.

Figure 10:
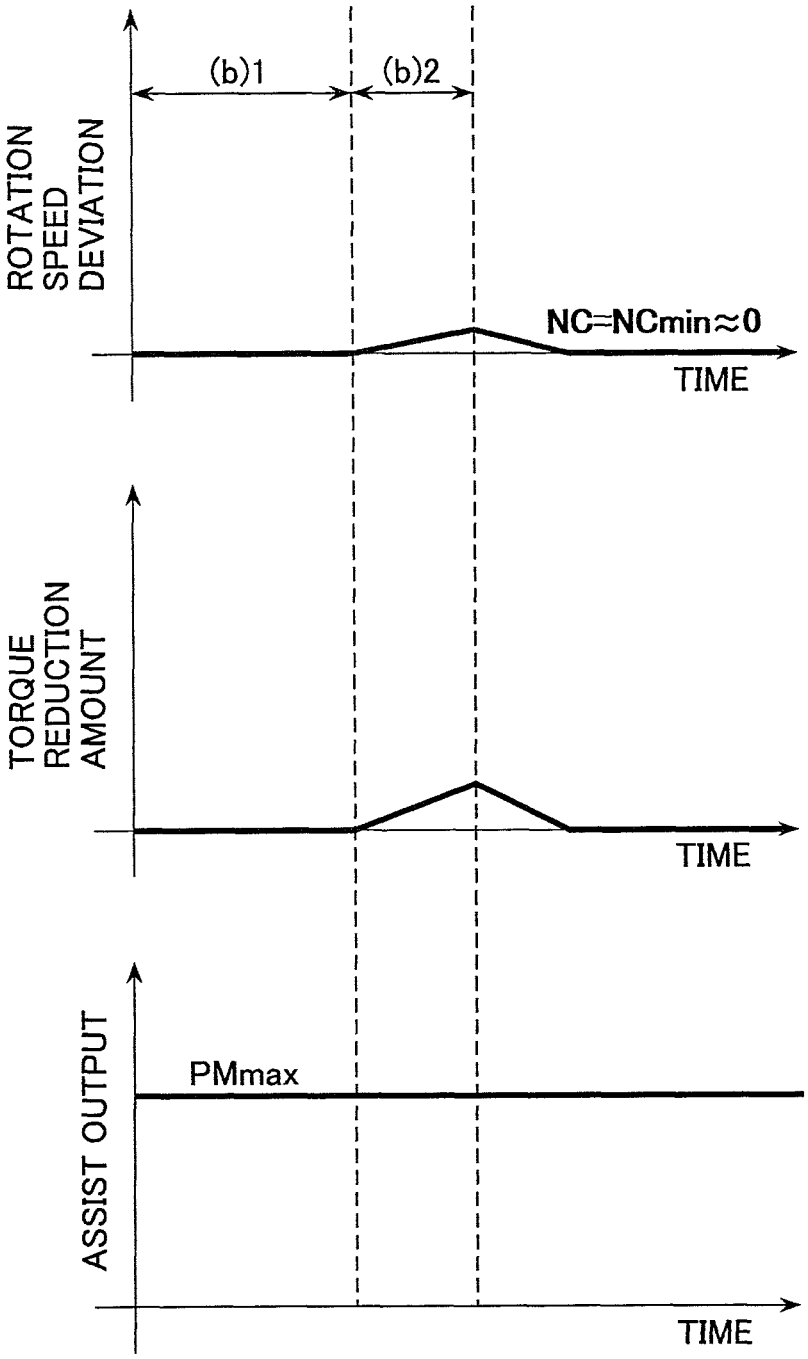
FIG. 10 shows an example illustrating how the construction machine is controlled when the load on the hydraulic pump 3 gradually increases to increase the rotation speed deviation ΔN in a situation where the engine 1 is running at the target rotation speed with the engine output and assist output maximized.

FIG. 10 shows an example illustrating how the construction machine is controlled when the load on the hydraulic pump 3 gradually increases to increase the rotation speed deviation ΔN in a situation where the engine 1 is running at the target rotation speed with the engine output and assist output maximized. In this instance, the setting NC of the rotation speed deviation is maintained at NCmin (i.e., a value close to zero) because the assist output value is at its maximum PMmax.

Referring to FIG. 10, the engine and assist outputs are maximized during period (b)1 so that the load on the hydraulic pump 3 is in equilibrium. Although the setting NC of the rotation speed deviation is maintained at a value (NCmin) close to zero, the pump absorption torque upper limit value is not limited because no rotation speed deviation ΔN occurs. When the load on the hydraulic pump 3 begins to increase after the start of period (b)2, the outputs of the engine 1 and motor generator 2 are already maximized. Therefore, the actual rotation speed gradually decreases so that the rotation speed deviation ΔN begins to increase. As this increases the rotation speed deviation ΔN above the setting NCmin, the pump absorption torque upper limit value is limited to reduce the amount of torque reduction. As described above, if the rotation speed deviation occurs while the engine and assist outputs are maximized, the load on the engine 1 can be reduced immediately. Therefore, the rotation speed of the engine 1 can be brought close to the target rotation speed while suppressing the transient generation of a great assist output. This also makes it possible to prevent an engine stall from being caused by overloading.

Figure 11:
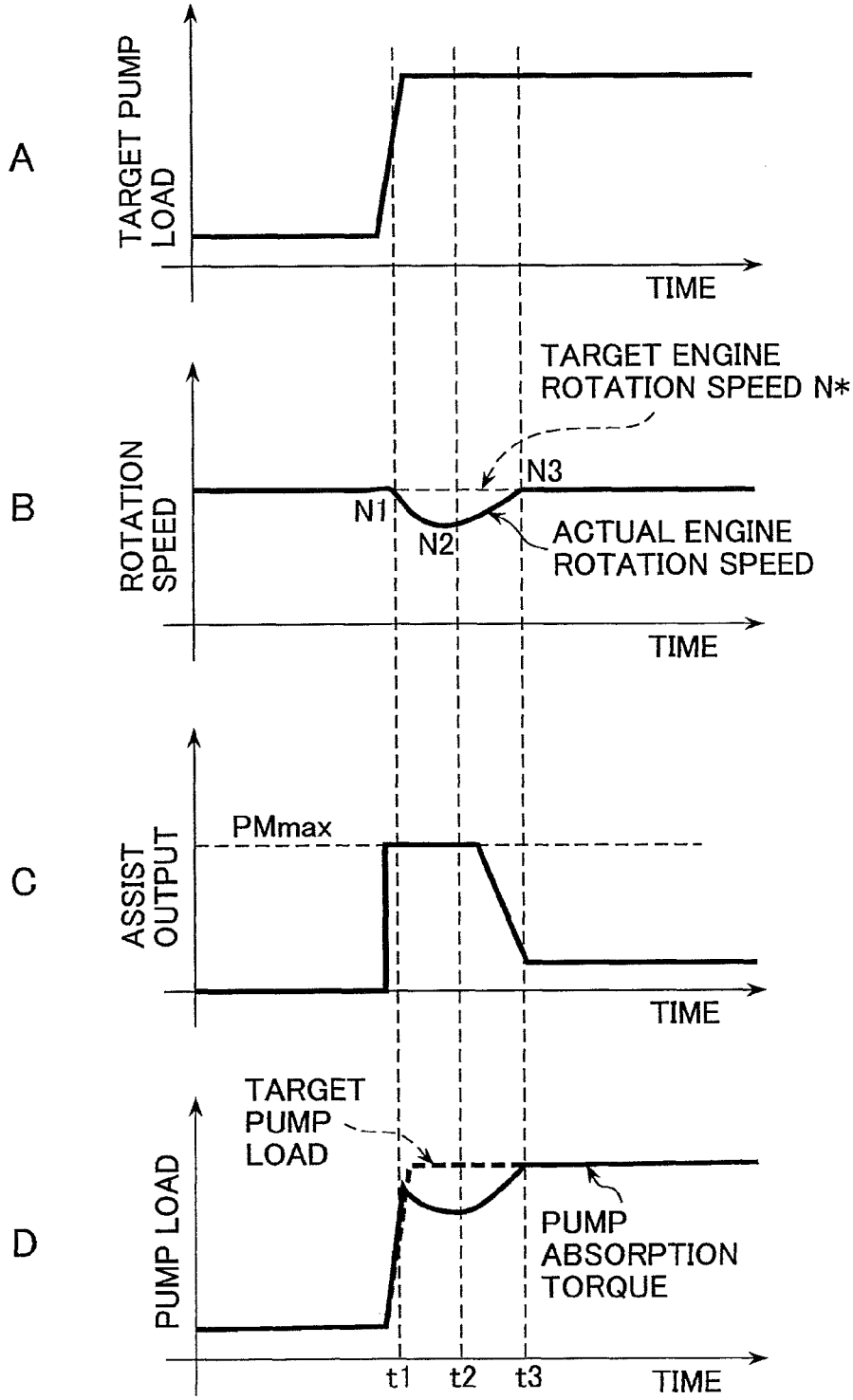
FIG. 11 shows an example illustrating how the construction machine is controlled when the load on the hydraulic pump 3 drastically increases in a situation where the engine 1 is actually running at a fixed target rotation speed N*.

FIG. 11 shows an example illustrating how the construction machine is controlled when the load on the hydraulic pump 3 drastically increases in a situation where the engine 1 is actually running at a fixed target rotation speed N*.

Let us now assume that the load on the hydraulic pump 3 is changed as indicated by graph A in FIG. 11 because a heavy-duty operation is suddenly performed by the front work device. In this instance, in accordance with computations that are performed by the power assist computation section 42 through the use of a feedforward input for the purpose of responding to a drastic increase in the pump load, the assist output computation section 19 calculates a maximum assist output value PMmax as a motor torque command value from an operating point at which the rotation speed deviation ΔN is small. Further, the motor generator 2 generates the maximum assist output value PMmax as indicated by graph C in FIG. 11. As described above, when the maximum assist output is generated, the setting of the rotation speed deviation is changed to the minimum value NCmin; however, the rotation speed deviation ΔN that occurs is small. Therefore, the pump absorption torque prevailing around time t1 at which a load is applied to the hydraulic pump 3 is rarely limited with respect to a target pump absorption torque (target pump load) as indicated by graph D in FIG. 11.

In the above situation, however, the engine 1 is transiently overloaded. Therefore, the actual rotation speed of the engine 1 gradually decreases as indicated in the period between time t1 and time t2 in graph B in FIG. 11. This gradually increases the rotation speed deviation ΔN, thereby increasing a torque reduction amount computed by the absorption torque upper limit computation section 23. Hence, the load on the hydraulic pump 3 is increasingly limited with respect to the target pump load as indicated in the period between time t1 and time t2 in graph D in FIG. 11. This causes the actual rotation speed of the engine 1 to stop decreasing at time t2. After time t2, the engine rotation speed is restored to the target rotation speed N* because the sum of the outputs of the engine 1 and motor generator 2 exceeds the pump load.

As described above, if the pump load increases to cause the rotation speed deviation ΔN while the engine 1 is operating at the fixed target rotation speed N* and the motor generator 2 is generating a sufficient assist output, the rotation speed of the engine 1 can be restored to the target rotation speed N* without further increasing the assist output by limiting the pump absorption torque upper limit value. This also makes it possible to reduce the possibility of the occurrence of lug-down. Further, if the increase in the pump load can be covered by the assist output generated by the motor generator 2, the engine rotation speed does not decrease. Therefore, the pump absorption torque upper limit value is left unlimited. This ensures that the operability of the front work device remains unimpaired.

Figure 12A:
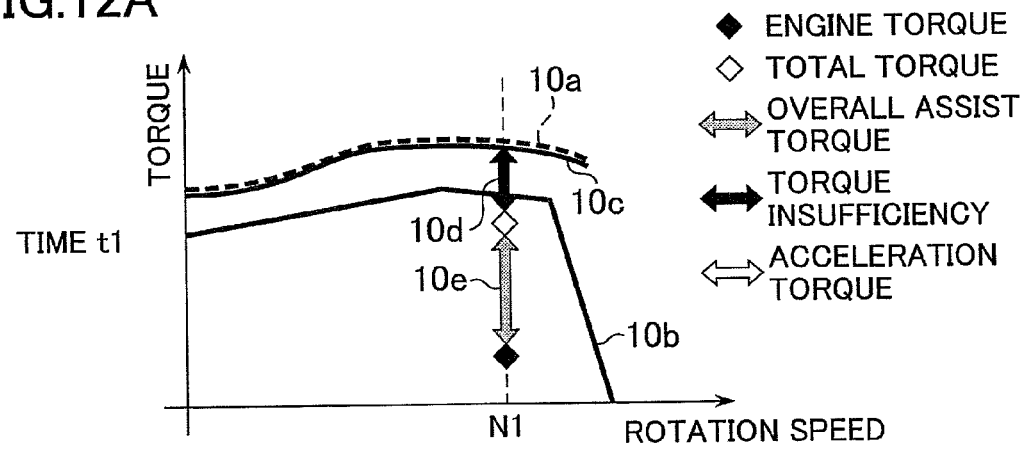
FIG. 12A is a diagram showing torque curves that prevail at time t1 in FIG. 11.
Figure 12B:
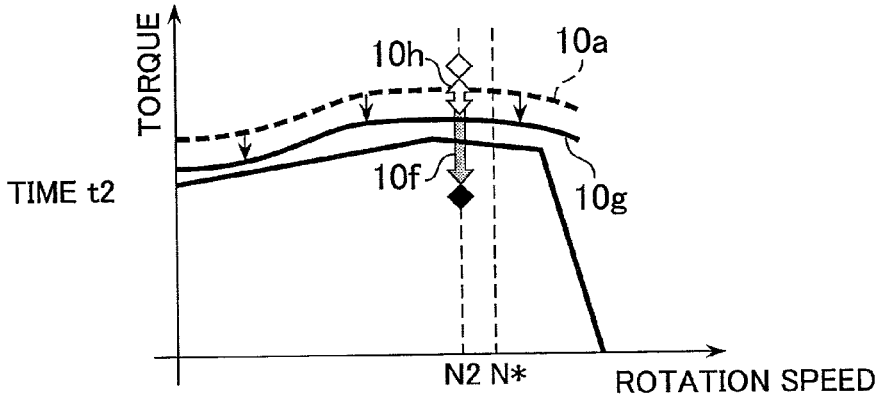
FIG. 12B is a diagram showing torque curves that prevail at time t2 in FIG. 11.
Figure 12C:
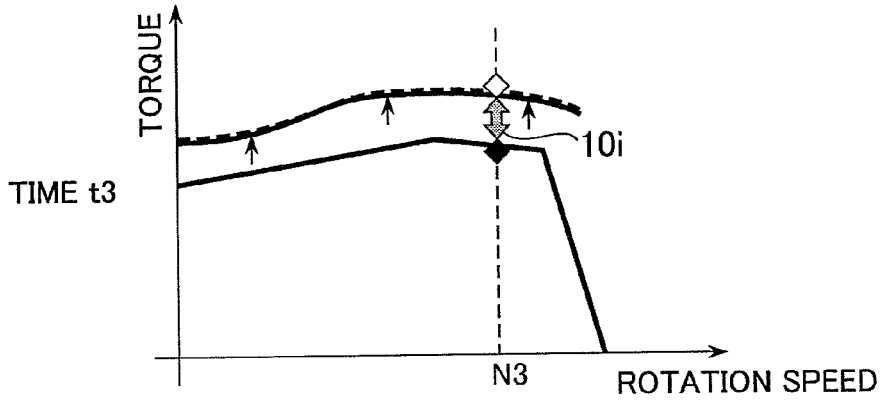
FIG. 12C is a diagram showing torque curves that prevail at time t3 in FIG. 11.

FIGS. 12A to 12C are diagrams showing torque curves that prevail at time t1, time t2, or time t3 in FIG. 11. The torque behavior of the engine 1, of the motor generator 2, and of the hydraulic pump 3 will now be described with reference to FIGS. 12A to 12C.

FIG. 12A is a diagram showing torque curves that prevail at time t1 in FIG. 11. Referring to FIG. 12A, a curve indicated at 10*a* represents a reference absorption torque upper limit value that is set by using FIG. 2, and a curve indicated at 10*b* represents the maximum torque characteristics of the engine 1 that prevail at various rotation speeds. At time t1, the actual rotation speed N1 of the engine 1 agrees with the target rotation speed N* so that no rotation speed deviation ΔN occurs. However, in accordance with an increase in the load on the hydraulic pump 3, the power assist computation section 42 calculates the maximum torque as a feedforward output. Then, at the maximum torque, the motor generator 2 provides an engine assist 10*e*. This increases the assist output to its maximum value PMmax and sets the rotation speed deviation to its minimum value NCmin. Thus, the limitation characteristics of the pump absorption torque upper limit value correspond to 5B in FIG. 7. However, as the rotation speed deviation ΔN that occurs subsequently is small, the torque reduction amount of the hydraulic pump 3 is small. Hence, control is exercised to set the absorption torque of the hydraulic pump 3 at an upper limit 10*c* that is substantially equivalent to a prescribed maximum absorption torque curve 10*a*. In this instance, a relatively small lug-down occurs due to the insufficiency 10*d* of the sum of the torque of the engine 1 and the torque of the motor generator 2 (the total torque of the engine 1 and motor generator 2).

FIG. 12B is a diagram showing torque curves that prevail at time t2 in FIG. 11. The rotation speed deviation ΔN (the difference between the actual rotation speed N2 and the target rotation speed N*) is greater than the time immediately after time t1. Although the torque of the engine 1 is higher than at time t1, it is still not maximized. Further, as the motor generator 2 continuously provides a power assist at time 1 and at time t2, an assist torque 10*f* remains the same as indicated in FIG. 12A. The rotation speed deviation ΔN then increases to further limit the pump absorption torque upper limit value. This causes the absorption torque of the hydraulic pump 3 to coincide with an absorption torque curve 10*g* that is limited with respect to the prescribed maximum absorption torque curve 10*a*. As a result, the total torque of the engine 1 and motor generator 2 is greater with respect to the pump load by 10*h*, which represents an extra torque. As the extra torque 10*h* makes it possible to accelerate the engine 1 to the target rotation speed N*, the actual rotation speed of the engine 1 can be raised without transiently generating a high assist output.

FIG. 12C is a diagram showing torque curves that prevail at time t3 in FIG. 11. At this time, the rotation speed deviation ΔN is resolved by the extra torque 10*h* so that the actual rotation speed N3 agrees with the target rotation speed N*. Hence, the absorption torque upper limit value of the hydraulic pump 3 is not limited. Consequently, the maximum absorption torque curve 10*a* of the hydraulic pump 3 is used as it is. However, from the viewpoint of providing improved fuel efficiency, the present embodiment is configured so that the pump torque represented by the maximum absorption torque curve 10*a* is higher than the maximum torque of the engine 1. Therefore, the insufficiency of torque is supplemented by causing the motor generator 2 to output a value that is computed as a power assist amount 10*i* by the assist output computation section 19. As the torque of the engine 1 is maximized at time t3, the power assist amount 10*i* is smaller than the amount of power assist 10*e* provided at time t1. Further, as the hydraulic pump 3 is not subjected to load limitation at time t3, an adequate operability can be obtained within the above-described region.

As described above, the present embodiment is configured so that the motor generator 2 can suppress the transient generation of a great assist output. This makes it possible to reduce the electric power consumption of the motor generator 2 and use a compact, low-output motor generator 2. Further, if a capacitor is used as the electrical storage device 10, the number of charging and discharging cycles can be reduced to provide improved efficiency because the motor generator 2 consumes a small amount of electric power. Furthermore, even if a battery is used as the electrical storage device 10, the electrical storage device 10 can be downsized because the amount of discharge can be reduced. In other words, the present embodiment can avoid the transient generation of a great assist output and reduce the amount of electric power consumption. This makes it possible to suppress an increase in the size of the motor generator 2 and of the electrical storage device 10 and provide a power saving, low fuel consumption hybrid construction machine.

Moreover, if an increased load is imposed on the hydraulic pump 3, the motor generator 2 increases its assist output accordingly, thereby limiting the pump absorption torque upper limit value. This makes it possible to prevent the load on the hydraulic pump 3 from exceeding the maximum value of the total output of the engine 1 and motor generator 2. Hence, the occurrence of an engine stall due to overloading can be avoided.

Meanwhile, if it is conceivable that a lug-down may occur due to an increase in the rotation speed deviation ΔN, which is caused when the load on the hydraulic pump 3 drastically changes from light to heavy, the pump absorption torque upper limit value is limited irrespective of the assist output value. As this permits the engine rotation speed to be immediately restored to the target rotation speed, it is possible to reduce the possibility of imposing a heavy load on the engine 1 and suppress the occurrence of a lug-down. Further, when the engine rotation speed is to be restored to the target rotation speed, the pump absorption torque upper limit value is limited to prevent the engine 1 from being overloaded. This makes it possible to provide improved emissions and reduce the amount of fuel consumption.

Figure 13:
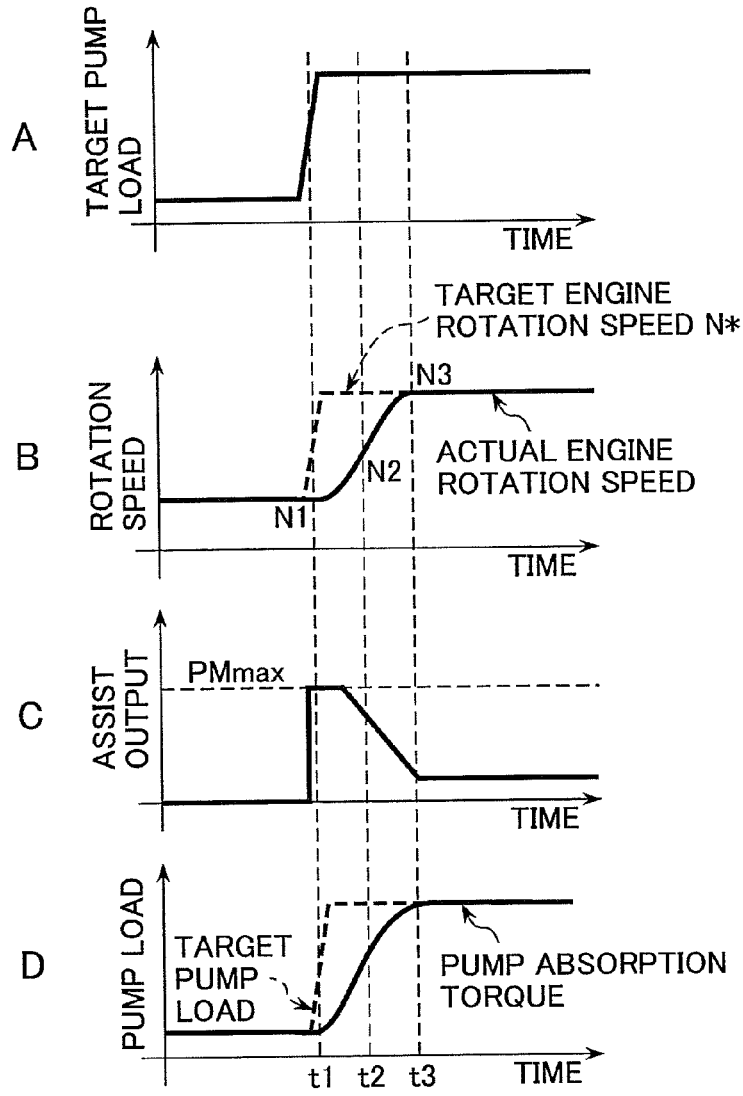
FIG. 13 shows an example illustrating how the construction machine is controlled when the target rotation speed of the engine 1 is drastically increased in response to a drastic increase in the load on the hydraulic pump 3.

FIG. 13 shows an example illustrating how the construction machine is controlled when the target rotation speed of the engine 1 is drastically increased in response to a drastic increase in the load on the hydraulic pump 3.

Let us now assume that the load on the hydraulic pump 3 is changed as indicated by graph A in FIG. 13 because a heavy-duty operation is suddenly performed by the front work device. In this instance, the target rotation speed setup section 17 quickly raises the target rotation speed as indicated by graph C in FIG. 13 to increase the engine output in response to a drastic increase in the pump load. In other words, a great rotation speed deviation temporarily occurs. The assist output computation section 19 then calculates the maximum assist output value PMmax as a motor torque command value in order to resolve the encountered rotation speed deviation ΔN. This causes the motor generator 2 to generate the maximum assist output value PMmax as indicated by graph C in FIG. 13. When the maximum assist output is generated as described above, the setting of the rotation speed deviation is changed to the minimum value NCmin. In this instance, the difference between the setting and the rotation speed deviation ΔN is extremely great. Therefore, the absorption torque upper limit computation section 23 indicates a large amount of torque reduction. The pump absorption torque upper limit value is then greatly decreased to significantly limit the pump load with respect to its target as indicated by graph D in FIG. 13.

As described above, when the target pump load increases, the pump absorption torque upper limit value is limited to reduce the load on the engine 1. Therefore, the rotation speed of the engine 1 can quickly follow the target rotation speed without causing the motor generator 2 to transiently generate a great assist output.

Further, as the rotation speed deviation ΔN decreases when the actual rotation speed of the engine 1 comes closer to the target rotation speed, the assist output generated by the motor generator 2 gradually decreases. Accordingly, the characteristic diagram of the pump absorption torque gradually shifts from 5B in FIGS. 7 to 5A, and from 5A to 5C. Therefore, the limitation on the pump absorption torque upper limit value is lifted when the rotation speed deviation ΔN decreases. This ensures that the operability of the front work device can be steadily maintained.

Figure 14A:
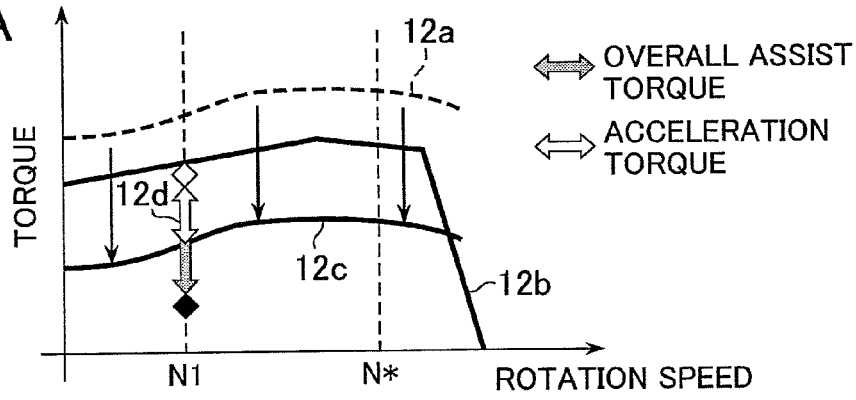
FIG. 14A is a diagram showing torque curves that prevail at time t1 in FIG. 13.
Figure 14B:
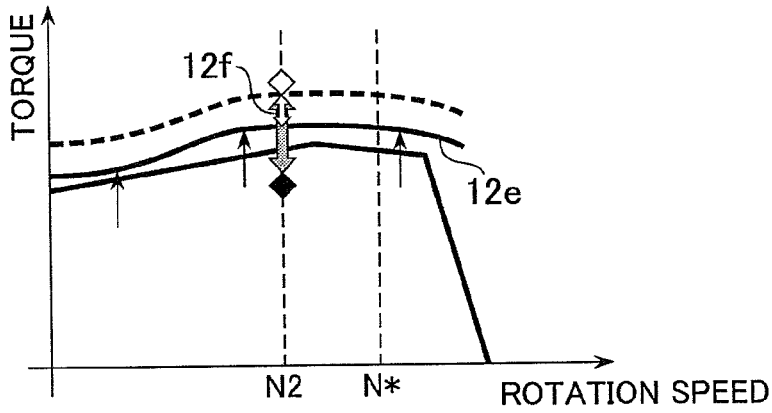
FIG. 14B is a diagram showing torque curves that prevail at time t2 in FIG. 13.
Figure 14C:
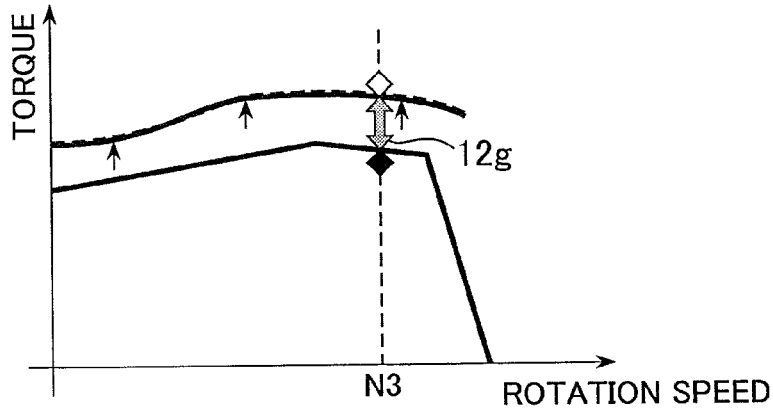
FIG. 14C is a diagram showing torque curves that prevail at time t3 in FIG. 13.

FIGS. 14A to 14C are diagram showing torque curves that prevail at time t1, time t2, or time t3 in FIG. 13. The torque behavior of the engine 1, of the motor generator 2, and of the hydraulic pump 3 will now be described with reference to FIGS. 14A to 14C.

FIG. 14A is a diagram showing torque curves that prevail at time t1 in FIG. 13. Referring to FIG. 14A, a curve indicated at 12*a* represents a reference absorption torque upper limit value that is set by using FIG. 2, and a curve indicated at 12*b* represents the maximum torque characteristics of the engine 1 that prevail at various rotation speeds. At time t1, there is an extremely great rotation speed deviation ΔN between the actual rotation speed N1 of the engine 1 and the target rotation speed N* so that the maximum torque of the motor generator 2 provides an engine assist. The assist output value is then set to the maximum value PMmax, and the setting of the rotation speed deviation is changed to the minimum value NCmin. Therefore, the limitation characteristics of the pump absorption torque upper limit value correspond to 5B in FIG. 7. Further, as the rotation speed deviation ΔN is great, a torque reduction amount appropriate for the rotation speed deviation ΔN is calculated. Thus, the absorption torque of the hydraulic pump 3 is significantly limited with respect to a prescribed maximum absorption torque curve 12*a*. As a result, the absorption torque of the hydraulic pump 3 is limited at the pump absorption torque upper limit value represented by a curve indicated at 12C. Accordingly, an extra portion 12*d* of the total torque of the engine 1 and motor generator 2 is used for acceleration for engine rotation speed buildup. Consequently, the engine rotation speed can be quickly raised. Moreover, the occurrence of a lug-down can be avoided because it is possible to prevent the engine 1 from being overloaded.

FIG. 14B is a diagram showing torque curves that prevail at time t2 in FIG. 13. As the rotation speed deviation ΔN (the difference between the actual rotation speed N2 and the target rotation speed N*) is smaller than at time t1, the amount of engine assist provided by the motor generator 2 is smaller than indicated in FIG. 14A. Thus, the limitation characteristics of the pump absorption torque upper limit value shift from 5B in FIGS. 7 to 5A, and the pump absorption torque is limited in accordance with the prevailing rotation speed deviation ΔN. The absorption torque of the hydraulic pump 3 is then controlled in accordance with the pump absorption torque upper limit value represented by a curve indicated at 12*e*, which imposes less stringent limitations than indicated in FIG. 14A. This ensures that the rotation speed of the engine 1 can be increased by an extra portion 12*f* of the total torque of the engine 1 and motor generator 2, as is the case at time t1.

FIG. 14C is a diagram showing torque curves that prevail at time t3 in FIG. 13. At this time, the rotation speed deviation ΔN is resolved because the actual rotation speed N3 agrees with the target rotation speed N*. Hence, the absorption torque upper limit value of the hydraulic pump 3 is not limited. Consequently, the maximum absorption torque curve 12*a* of the hydraulic pump 3 is used as it is. However, from the viewpoint of providing improved fuel efficiency, the present embodiment is configured so that the pump torque represented by the maximum absorption torque curve 12*a* is higher than the maximum torque of the engine 1. Therefore, the insufficiency of torque is supplemented by causing the motor generator 2 to output a value that is computed as a power assist amount 12*g* by the assist output computation section 19. Further, as the hydraulic pump 3 is not subjected to load limitation at time t3, an adequate operability can be obtained within the above-described region.

As described above, the present embodiment is configured so that the acceleration assist provided by the motor generator 2 can be reduced by decreasing the pump absorption torque upper limit value at the time of acceleration. This makes it possible to reduce the amount of electric power consumption and suppress an increase in the size of the motor generator 2 and of the electrical storage device 10. Further, as this ensures that the actual rotation speed of the engine 1 can be quickly raised to the target rotation speed, it is possible to prevent the engine 1 from being overloaded, suppress high-concentration combustion, and provide improved emissions. Moreover, when a capacitor is used as the electrical storage device 10, increased power savings can be provided because the number of charging and discharging cycles can be reduced to provide improved efficiency.

The present embodiment intentionally reduces the pump load on a temporary basis when the load is drastically increased. In such an instance, the response to an operation of the front work device may be lost. In general, however, the load on the construction machine increases when, for instance, the front work device does not quickly move at the beginning of an excavating operation. Therefore, the operability of the front work device remains unimpaired in most actual cases. Consequently, the present embodiment can maintain the operability of the front work device.

Meanwhile, the present embodiment has been described on the assumption that the setting NC of the rotation speed deviation is determined in relation to the assist output value. However, an alternative is to determine the setting NC in relation to the storage amount of the electrical storage device 10. Another alternative is to determine the setting NC in relation to both the storage amount and the assist output value. A case where the former alternative is adopted will be described in detail below.

Figure 15:
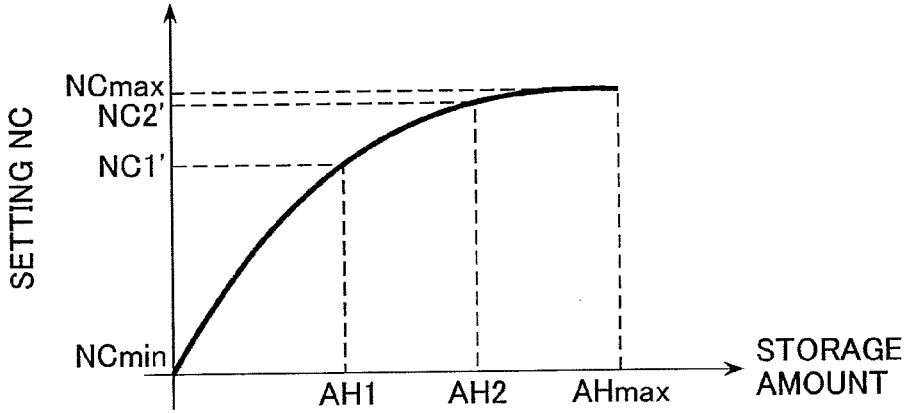
FIG. 15 is a diagram illustrating the relationship between the setting value NC of the rotation speed deviation according to the present embodiment and the storage amount of an electrical storage device 10.

FIG. 15 is a diagram illustrating the relationship between the setting NC of the rotation speed deviation according to the present embodiment and the storage amount of the electrical storage device 10. The setting NC shown in FIG. 15 takes the minimum value (zero) when the storage amount AH is zero and takes the maximum value NCmax when the storage amount AH is a maximum value AMmax. The setting NC decreases with a decrease in the storage amount of the electrical storage device 10.

Figure 16:
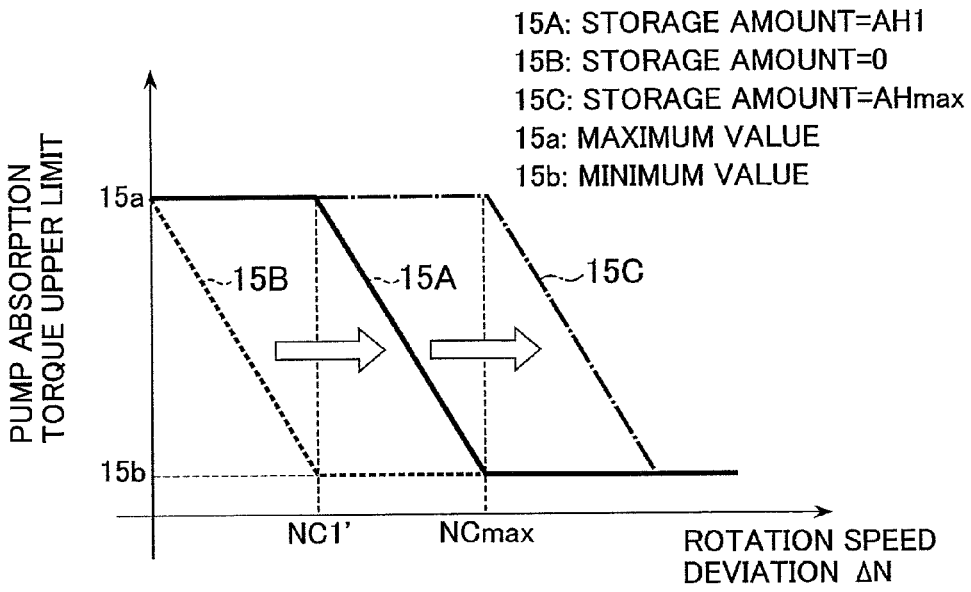
FIG. 16 shows exemplary changes in a characteristic diagram indicative of the pump absorption torque upper limit value that occur when the storage amount of the electrical storage device is changed.

FIG. 16 shows exemplary changes in the characteristic diagram of the pump absorption torque upper limit value that occur when the storage amount of the electrical storage device 10 is changed (i.e., when the setting NC is changed). A characteristic diagram obtained by parallelly shifting a reference characteristic diagram in a horizontal direction (in the direction of a horizontal axis) in accordance with the storage amount will be described here as a characteristic diagram concerning each storage amount (in this instance, the characteristic diagrams are parallelly shifted in a rightward direction, as indicated by arrows in FIG. 16, in accordance with an increase in the storage amount).

Referring to FIG. 16, let us assume that the characteristic diagram of the pump absorption torque upper limit value prevailing when the storage amount shown in FIG. 15 is in an AH1 state (setting NC=NC1') is in a 15A state shown in FIG. 16, and that the characteristic diagram prevailing when the storage amount is zero (setting NC=NCmin≈0) is in a 15B state, and further that the characteristic diagram prevailing when the storage amount is maximized (setting NC=NCmax) is in a 15C state. In this case, if, for example, the storage amount of the electrical storage device 10, which is detected by storage amount detection means 22, is decreased while the characteristic diagram of the pump absorption torque upper limit value indicated at 15A is used, the characteristic diagram shifts toward the 15B state. If the characteristic diagram is changed as described above to change the setting to a value smaller than NC1' in a situation where the motor generator 2 cannot generate an adequate assist output due to the shortfall in the storage amount, a value at which the pump absorption torque upper limit begins to decrease is smaller than in the 15A state (NC1'). This ensures that if the motor generator 2 cannot provide an assist due to the shortfall in the storage amount, the load on the hydraulic pump 3 is preferentially decreased to limit the absorption torque upper limit value of the hydraulic pump 3 while the rotation speed deviation ΔN is small. As a result, it is possible to not only prevent an engine stall, but also avoid a lug-down.

Further, if, in association with the above, the motor generator 2 is generating electric power, it is probable that the storage amount of the electrical storage device 10 is small. Therefore, if the motor generator 2 is generating electric power, setup may be performed so that the setting NC decreases with an increase in the amount of electric power generated by the motor generator 2. In other words, the similarity to the 15B characteristic diagram increases with an increase in the amount of generated electric power. If, for instance, the 15B characteristic diagram is used when the motor generator 2 generates electric power and the employed target rotation speed of the engine 1 is within a high rotation speed region in which the motor generator 2 can generate electric power with high efficiency, the rotation speed deviation ΔN occurs on a temporary basis before the rotation speed of the engine 1 reaches the target rotation speed. However, if the rotation speed deviation ΔN occurs during the use of the 15B characteristic diagram, the pump absorption torque upper limit value decreases immediately, thereby making it possible to reduce the load on the hydraulic pump 3. Consequently, even if no assist output is generated by the motor generator 2, the rotation speed can be quickly increased by the engine alone to generate electric power.

When electric power is to be generated by the motor generator 2, setup should preferably be performed so that the output determination section 43 of the assist output computation section 19 provide a certain amount of acceleration assist without issuing a motor torque command for regeneration before the engine rotation speed adequately builds up, or that the motor generator 2 remain in a zero torque state and impose no load on the engine 1 before the engine rotation speed adequately builds up. When such setup is performed, an electric power generation operation performed by the motor generator 2 imposes a reduced load on the engine 1. This makes it possible to not only reduce the time required for the actual rotation speed of the engine 1 to rise to the target rotation speed, but also generate electric power in a high rotation speed region in which high efficiency is achieved. As a result, improved fuel efficiency can be provided.

The invention claimed is:

1. A control device for a construction machine having an engine, a variable displacement hydraulic pump driven by the engine, a hydraulic actuator driven by a hydraulic fluid discharged from the hydraulic pump, a motor generator for exchanging torque with the engine, electrical storage means for supplying electric power to the motor generator, and pump displacement adjustment means for adjusting the displacement of the hydraulic pump in accordance with an operation signal, the control device comprising:

actual rotation speed detection means that detects an actual rotation speed of the engine;

target rotation speed setup means that sets a target rotation speed of the engine;

assist output computation means that calculates an assist output value that is to be generated by the motor generator in order to assist the output of the engine;

absorption torque upper limit computation means that calculates an absorption torque upper limit value of the hydraulic pump; and operation signal generation means that generates the operation signal to be output to the pump displacement adjustment means for the purpose of adjusting the displacement of the hydraulic pump in accordance with the value calculated by the absorption torque upper limit computation means;

wherein, when a rotation speed deviation indicative of the difference between the actual rotation speed, the data about the actual rotation speed being input from the actual rotation speed detection means, and the target rotation speed, the data about the target rotation speed being input from the target rotation speed setup means, is equal to or more than a setting value that is determined in accordance with the assist output value calculated by the assist output computation means, the absorption torque upper limit computation means reduces the absorption torque upper limit value of the hydraulic pump from the calculated value.

2. The control device according to claim 1, wherein the setting value of the rotation speed deviation decreases with an increase in the assist output value of the motor generator.

3. The control device according to claim 1, further comprising:

storage amount detection means that detects a storage amount of the electrical storage means;

wherein the setting value of the rotation speed deviation decreases with a decrease in the storage amount of the electrical storage means, the data about the storage amount of the electrical storage means being input from the storage amount detection means.

4. The control device according to claim 1, further comprising:

load detection means that detects a load on the hydraulic pump; and engine output detection means that detects an actual output of the engine;

wherein the assist output computation means calculates an acceleration assist output value in accordance with the rotation speed deviation and, calculates a power assist output value in accordance with the difference between the load on the hydraulic pump, the data about the load on the hydraulic pump being input from the load detection means, and the engine output, the data about the engine output being input from the engine output detection means.

5. The control device according to claim 4, further comprising:

maximum engine output computation means that calculates the maximum output value of the engine in accordance with the actual rotation speed, the data about the actual rotation speed being input from the actual rotation speed detection means;

wherein the assist output computation means calculates the minimum value of the power assist output value by further referencing the maximum engine output value, the data about the maximum engine output value being input from the maximum engine output computation means.

6. The control device according to claim 2, wherein the setting value of the rotation speed deviation continuously changes in accordance with changes in the assist output of the motor generator.

7. The control device according to claim 1, wherein the target rotation speed setup means sets the target rotation speed at an operating point at which the fuel consumption amount for the output required of the engine is minimized.

8. The control device according to claim 1, wherein, when the rotation speed deviation is equal to or more than the setting value, the absorption torque upper limit computation means increases the amount of reduction of the absorption torque upper limit value of the hydraulic pump in accordance with the amount of the difference between the rotation speed deviation and the setting value.

* * * * *